US005292405A

United States Patent [19]

Wicks

[11] Patent Number: 5,292,405

[45] Date of Patent: Mar. 8, 1994

[54] ELECTROLYTIC CELL AND METHOD

[75] Inventor: Graham Wicks, Aberdeen, Scotland

[73] Assignee: Baker Hughes Incorporated, Houston, Tex.

[21] Appl. No.: 900,051

[22] Filed: Jun. 17, 1992

[51] Int. Cl.[5] ..... C25B 1/00; C25B 9/00; C25B 15/08

[52] U.S. Cl. ..... 204/1.11; 204/268; 204/269; 204/279; 204/284; 204/290 R; 204/291; 204/292

[58] Field of Search ..... 204/253-256, 204/268-270, 284, 290 R, 291, 292, 279, 1.11

[56] References Cited

U.S. PATENT DOCUMENTS

| | | | |
|---|---|---|---|
| 3,546,089 | 12/1970 | Schneider | 204/278 |
| 3,622,479 | 11/1971 | Schneider | 204/149 |
| 3,975,247 | 8/1976 | Stralser | 204/152 |
| 4,124,480 | 11/1978 | Stevenson | 204/268 |
| 4,193,858 | 3/1980 | Loeffler | 204/268 |
| 4,372,827 | 2/1983 | Spaziante et al. | 204/268 X |
| 4,790,923 | 12/1988 | Stillman | 204/268 |

FOREIGN PATENT DOCUMENTS

| | | |
|---|---|---|
| 0365983 | 1/1932 | United Kingdom . |
| 0932945 | 7/1963 | United Kingdom . |
| 1124185 | 8/1968 | United Kingdom . |
| 1184580 | 3/1970 | United Kingdom . |
| 1267516 | 3/1972 | United Kingdom . |
| 1348419 | 3/1974 | United Kingdom . |
| 1529989 | 10/1978 | United Kingdom . |

*Primary Examiner*—Donald R. Valentine
*Attorney, Agent, or Firm*—Rosenblatt and Associates

[57] ABSTRACT

An electrolysis cell provides a plurality of electrode stacks arranged electrically and mechanically back-to-back in a vertical orientation to develop an electrically neutral effluent. The electrode stacks comprise a plurality of electrode plates that seal against an inert housing by seals with a U-shaped cross-section. The cell is fully insulated and provides a series electrolyte flow path.

20 Claims, 4 Drawing Sheets

ELECTROLYTIC CELL AND METHOD

BACKGROUND OF THE INVENTION

The present invention relates generally to electrolytic flow cells, and more particularly to electrolytic cells that generate sodium hypochlorite from brine or seawater.

Prior art electrolytic flow cells have a plurality of parallel electrodes that are spaced apart along their outer edges and sealed along their perimeters to form an electrode stack. Electrolyte is admitted through an inlet at the base of the electrode stack and flows in the space between successive adjacent electrodes to an outlet at the top of the electrode stack. The electrolyte passes from one space between electrodes in the electrode stack to the next adjacent space between electrodes through apertures in each electrode. The apertures are horizontally displaced between adjacent electrodes to maximize the length of the flow path over which electrolysis takes place.

The outermost electrodes in the stack are monopolar while the intermediate electrodes are bipolar. Electrical power can then be applied to the electrode stack via electrical connections to the outer monopolar electrodes and this creates an anodic and a cathodic surface on each intermediate bipolar electrode. This causes electrolysis to occur as the electrolyte passes through the cell.

However, these electrolytic cells of the prior art suffer from the disadvantage that the voltage applied to the electrode stack is limited to a threshold value where the material(s) comprising the electrodes themselves begin to undergo electrolysis, limiting the efficiency of the electrolytic cell. Furthermore, passing the electrolyte between a single stack of electrodes results in an electrically charged electrolyte effluent. This electrically charged effluent can present a safety hazard if the electrolyte leaks and contacts a worker. Further, since the effluent is electrically charged, instrumentation valves and associated pipework in the effluent stream before and after the electrolytic cell must be lined or enclosed in or made of a plastic material and sealed against the charge, to prevent accidental contact with or induced corrosion of metallic parts that are in contact with ground potential, thereby increasing the complexity and cost of the cell's associated instrumentation pipework and fittings. The effects of stray current corrosion on the inlet pipework and instruments can be greater than on the outlet as the cell's positive power connection, i.e., the highest potential, is at the inlet to the cell.

SUMMARY OF THE INVENTION

The present invention overcomes these problems by providing an electrolytic cell with two or more electrode stacks, arranged back-to-back in flow path series. As used herein, the phrase "back-to-back" refers to the fact that two or more electrode stacks are arranged so that effluent leaves one stack at a cathodic terminal and enters the next stack at a cathodic terminal, or leaves one stack and enters the next stack at an anodic terminal. This has the effect of both increasing the area over which electrolysis can occur and, by ensuring the adjacent electrode stack has opposite polarity, reducing or entirely neutralizing the electrical charge in the electrolyte exiting the cell. This minimizes or eliminates the safety risk in the event of a leak at the discharge of the cell and significantly simplifies requirements placed on instrumentation, such as flow sensors, in the effluent stream. In an electrolytic cell of the present invention, standard, unlined instrumentation pipework and fittings can be used.

According to a preferred embodiment of the present invention the electrode stacks are constructed to fit and seal together in an inert, insulated housing to provide a simple and safe electrolytic cell that is both flexible to use and easy to maintain.

The electrodes in each stack may take the form of circular plates of which at least one face is treated with a noble metal or a mixture of noble metals. Alternatively, the electrodes may also be made of ceramic The present invention may also include a stack of copper electrodes that are powered at a lower voltage (and current) just before the discharge from the cell. The electrodes coated with a noble metal or made of ceramic produce hypochlorous acid ions and the copper electrodes produce cuprous or cupric ions. The copper electrodes are gradually eroded or "sacrificed", combined with the hypochlorous acid ions, to produce a synergistic anti-foulant solution, with a significantly lower consumption of copper than prior art units.

The electrodes of a stack may be spaced apart by a spacer along the outer edge of each electrode and be sealed against the wall of the housing by an O-ring positioned along the outer circumferential edge of the electrode. As a further alternative, the spacer and seal can be combined into a U-shaped unit that receives the outer edge of each electrode in the well of the U. This U-shaped unit combines the function of sealing the edge of the electrode against the enclosing housing and spacing electrode plates apart. This structure decreases the number of parts to be assembled thereby simplifying assembly and eliminates the possibility of leakage between spacer and O-ring.

Electrical power is applied to each stack by means of connections to the monopolar electrodes in each electrode stack. The connections are arranged so that alternate electrode stacks have opposite polarities, so that in the case of the electrolyte cell with only two electrode stacks, the electrolyte flows from the cathode to the anode then anode to cathode or vice versa. In a preferred embodiment, power is supplied at a center connection between the electrode stacks.

This arrangement provides the additional benefit of sufficiently high flow rate of the electrolyte so that the electrodes are not fouled by the deposition of electrolysis byproduct salts. The electrode stacks are preferably arranged in a vertical orientation to ensure that gas byproducts are carried along with the electrolyte and evacuated from the cell. Further, since the cell housing is formed of a non-conductive, inert material and is insulated from the electrodes, the cell can be used in areas requiring enhanced safety equipment. Also, with each adjacent electrode stack independently powered from its own electrical connection, failure of one stack does not disable the entire cell since other stacks remain powered and continue to function.

These and other advantages of the present invention will be readily apparent to those of skill in the art from the following description when read in conjunction with the following drawing figures.

BRIEF DESCRIPTION OF THE DRAWING FIGURES

The invention will now be further described with reference to the accompanying drawings.

DETAILED DESCRIPTION OF PREFERRED EMBODIMENTS

Figure 1:
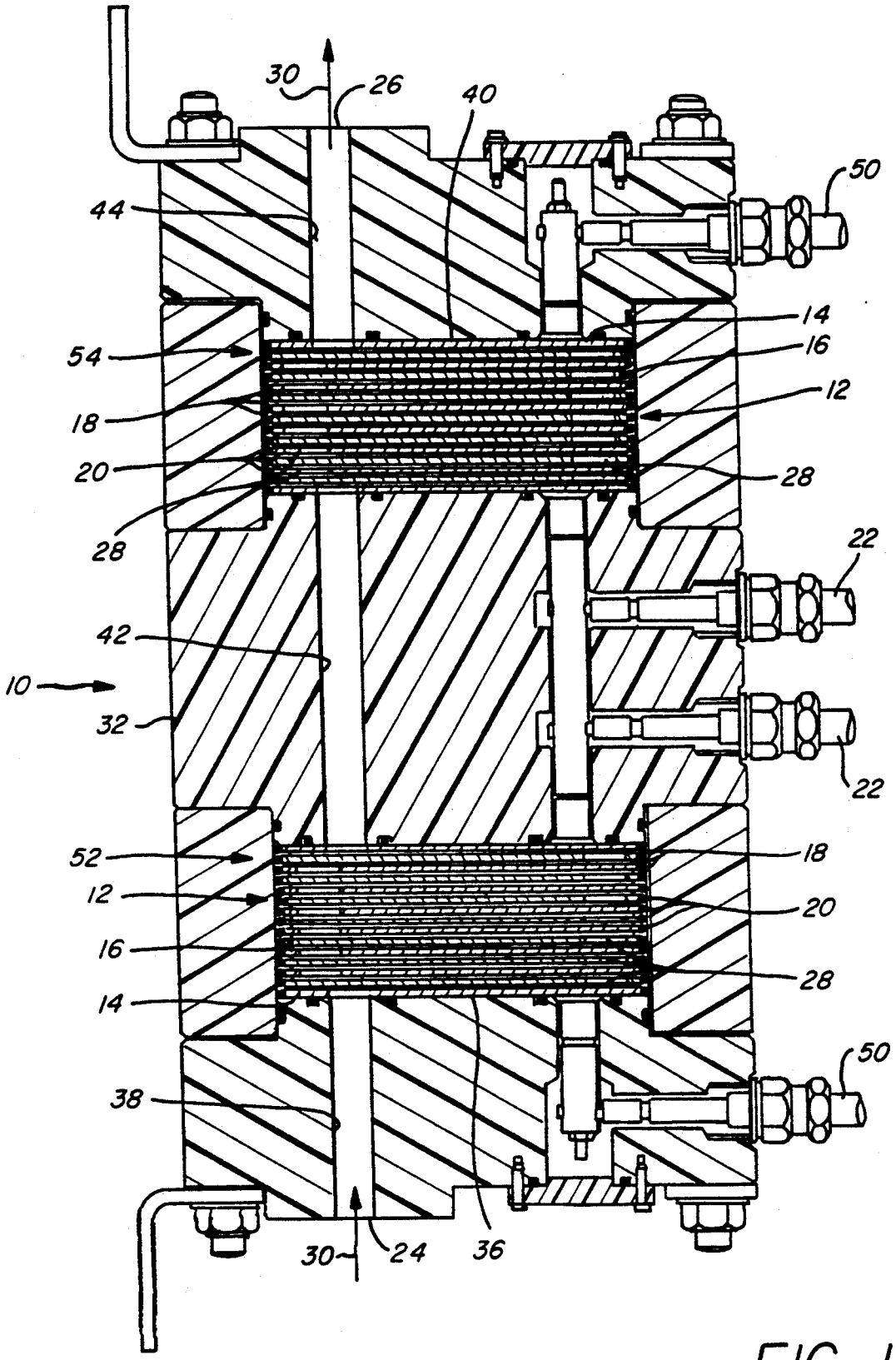
FIG. 1 depicts a sectional view of an electrolytic cell.

FIG. 1 depicts an electrolytic cell 10 of the present invention. This electrolytic cell 10 comprises two electrode stacks 12, arranged so that their electrolytic flow paths are in series. That is, electrolyte or brine to be electrolyzed flows in an intake 24, through the electrode stacks, and out at discharge 26. The electrolyte flows from the intake 24 to a first stack 36 through a conduit 38, from the first stack to a second stack 40 through a conduit 42, and to the discharge 26 through a conduit 44.

Figure 4A:
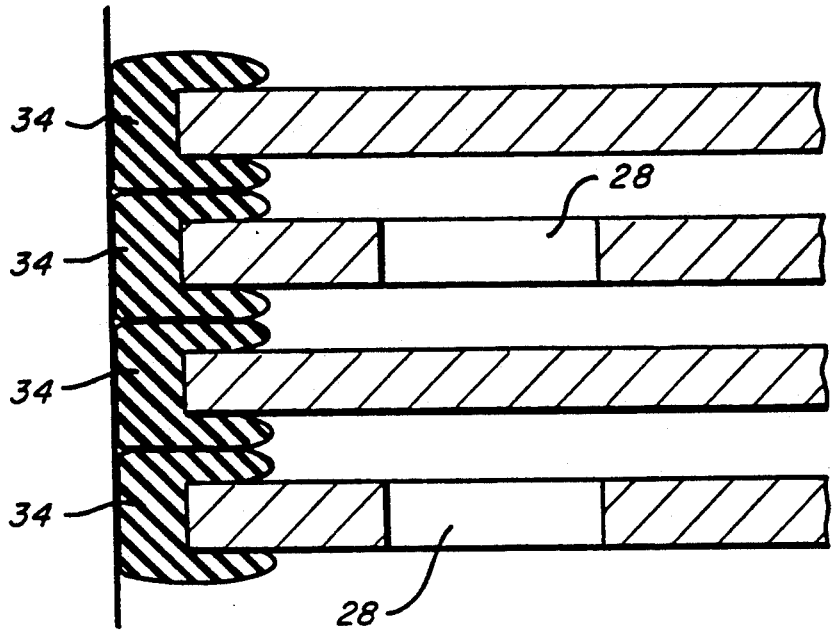
FIGS. 4A and 4B depict cross sections of electrode seals of the preferred embodiments.
Figure 4B:
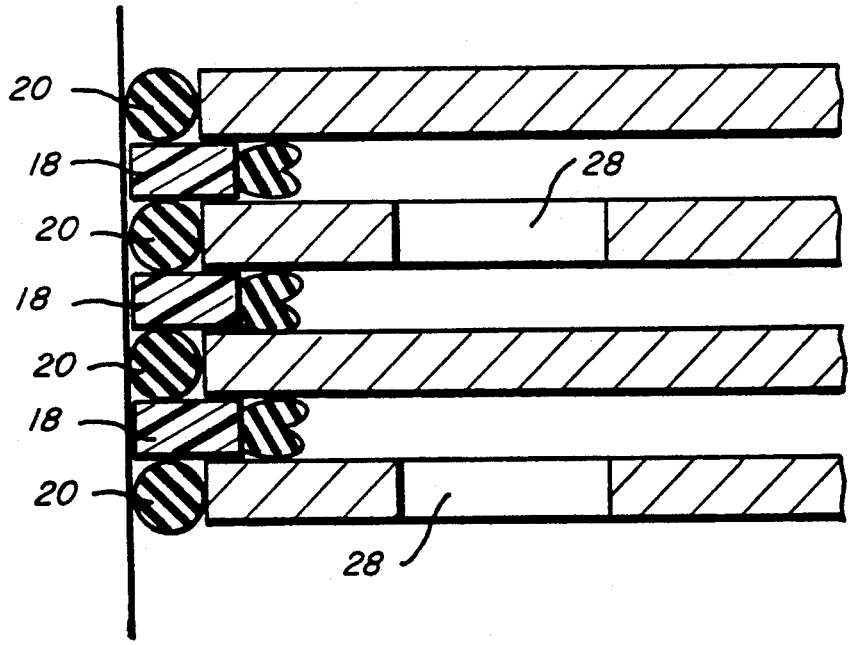

Each electrode stack 12 is made up of a plurality of parallel electrodes 14, 16 that are kept a fixed distance apart by spacers/seals 18 and sealed along their perimeters by O-rings 20, as shown in greater detail in FIGS. 4A and 4B. As shown in FIG. 4B, the spacers/seals 18 act as the primary seal and the O-rings 20 act as the secondary seal. In a preferred embodiment, spacers 18 and O-rings 20 are combined to form a single U-shaped seal that receives the outer edge of the electrode in the well of the U, as shown in FIG. 4A. The outermost electrodes are monopolar electrodes 14, while the intermediate electrodes are bipolar electrodes 16. In a preferred embodiment, as shown in FIG. 1, the intrastack spacing between electrodes 14, 16 is substantially equal.

External electrical power is applied to each electrode stack 12 in the electrolytic cell 10 via electrical connections 22 to the outer monopolar electrodes 14. In an alternative embodiment shown in FIG. 2, adjacent electrode stacks 12 share a common electrical connection 22. One polarity of electrical power energizes monopolar electrodes 14 through the common electrical connection 22 and conductor 46. A conduit 48 directs electrolyte from a lower stack 52 to a higher stack 54.

Figure 2:
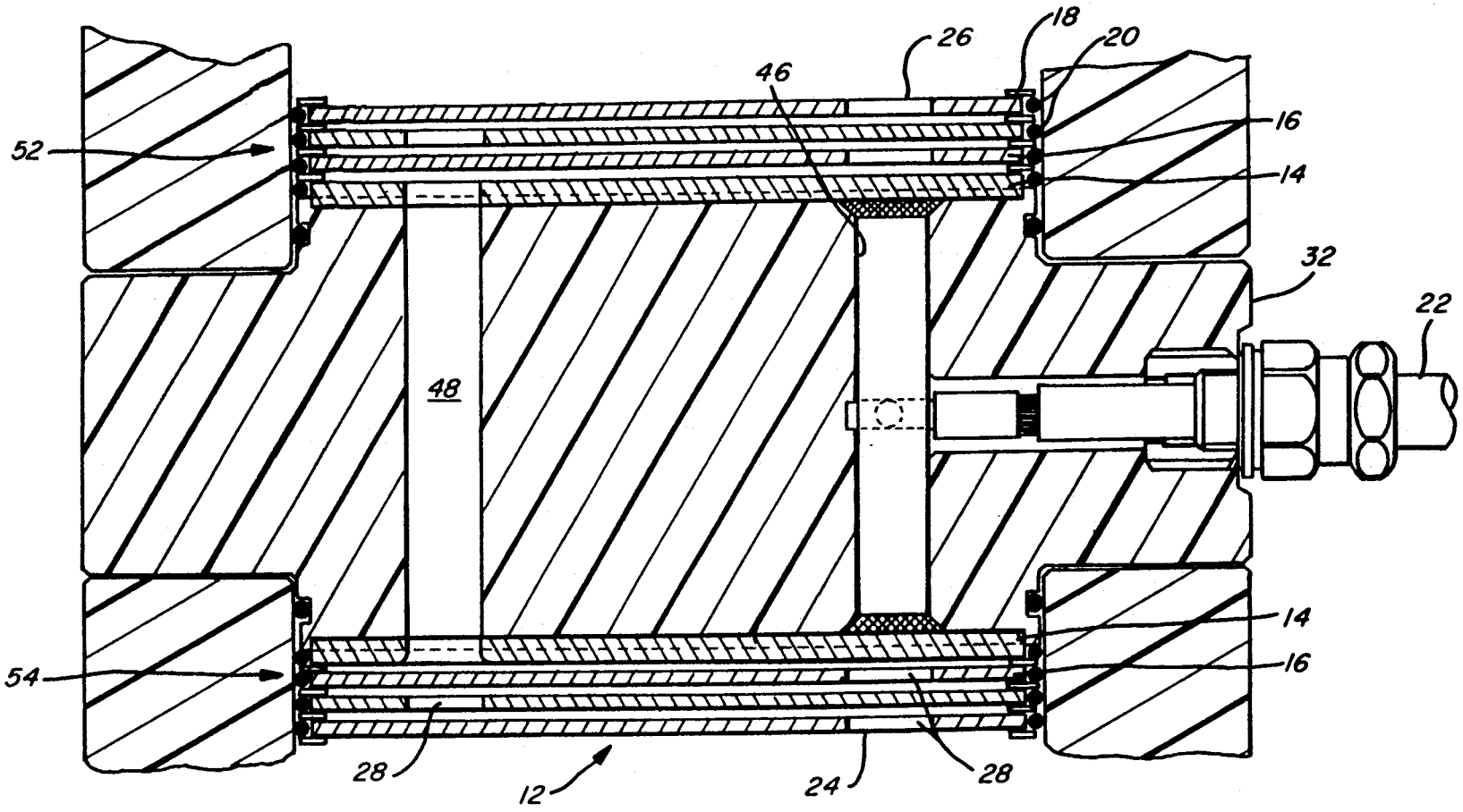
FIG. 2 depicts a sectional view through part of the electrolytic cell of an alternative embodiment of the invention in which adjacent electrode stacks are powered from one electrical conductor.
Figure 3:
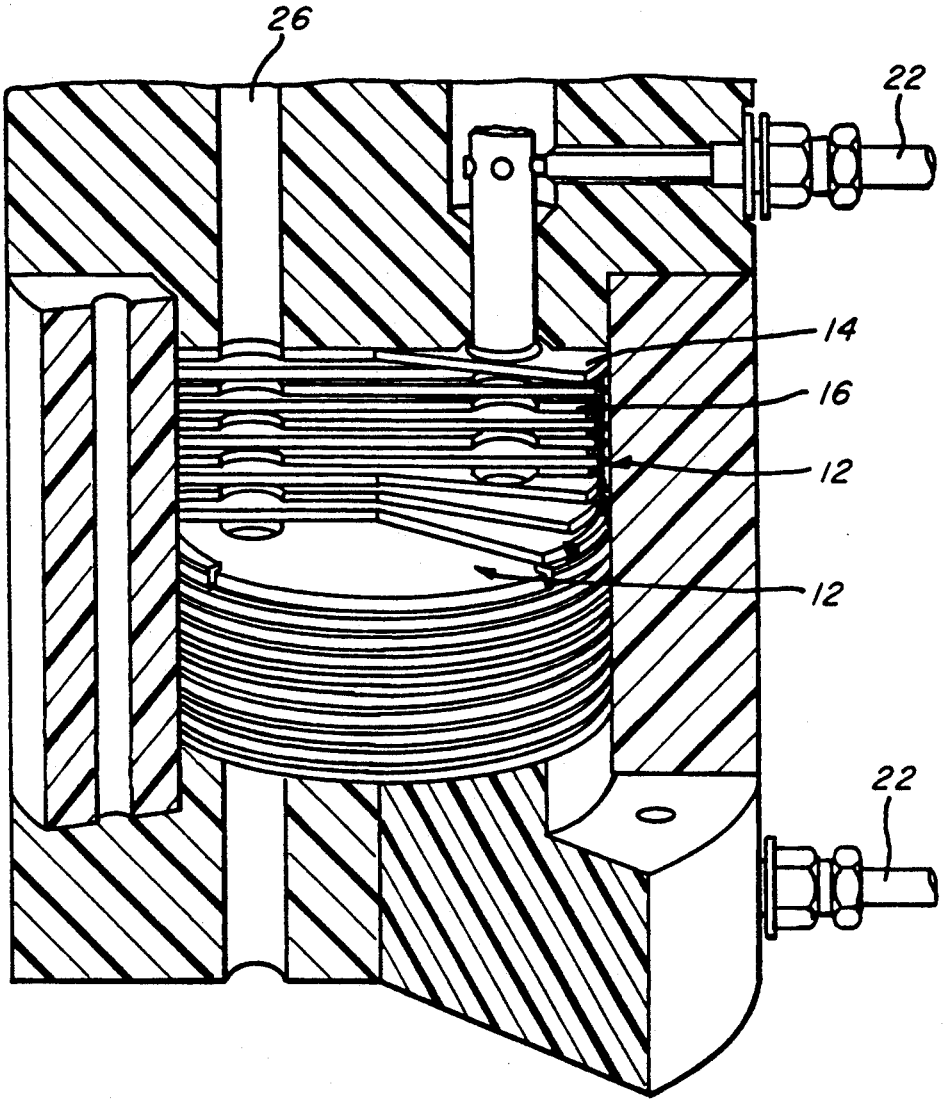
FIG. 3 depicts a partial section view through one electrode stack.

The arrangement of electrical connections shown in FIGS. 1 and 2 may be referred to as "center powered." That is, power is provided by connection 22 to the "center" of the cell, i.e., between the electrode stacks 12. The electrical circuit is completed by connections 50 (not shown in FIG. 2) which return to the power source. The connections 22 conventionally have a positive pole and the connections 50 have a negative pole. Having an independent conductor for each stack provides redundancy in that failure of one connection does not disable the entire cell, while providing power to both stacks from a single conductor eliminates one conductor and reduces the overall cost of the cell. In a preferred embodiment, the housing 32, FIG. 2, is made by an injection molding process and is made of polypropylene or other appropriate moldable material. In this embodiment, the electrodes are permanently molded into the housing. Alternatively, the housing can be machined from a block of an insulating material such as polypropylene.

The application of external electrical power to the electrolytic cell 10 creates an anodic and a cathodic surface on each bipolar electrode 16.

As shown in FIG. 2, each electrode 14, 16 is provided with an aperture 28 at one side and the electrodes 14, 16 are arranged so that each aperture 28 is displaced from the aperture in each adjacent electrode 14, 16, preferably by 180 degrees. This configuration provides a series flow path. That is, electrolyte must pass through each space between electrodes from inlet to discharge, providing for a highly turbulent electrolyte flow path.

Electrolyte 30 passes into the electrolytic cell 10 through an inlet or intake 24 and then through the spaces between adjacent electrodes 14, 16 in each electrode stack 12 in turn. Electrolysis is driven by the application of external electrical current to the electrolytic cell 10. The electrolyte 30 containing the product of the electrolysis passes out of the cell through an outlet or discharge 26.

As shown in FIG. 1, the spacing between electrode stacks 12 is substantially greater than the intrastack electrode spacing.

The provision of multiple electrode stacks 12 increases the effective area of the electrodes over which electrolysis occurs and reduces or entirely neutralizes the net electrical charge in the electrolyte exiting the electrolytic cell.

The electrodes 14, 16 in each electrode stack 12 are preferably made of or coated with a noble metal or a mixture of noble metals. Alternatively, the electrodes may be made of ceramic. Titanium may be used as the major structural material (i.e., the "substrate" or the "carrier metal") of the electrodes 14, 16. The nobel metal greatly enhances electrolysis by conducting electrical current from the electrode into the electrolyte. Using titanium alone, without the noble metal coating, results in very inefficient electrolysis.

As just mentioned, the electrodes 14, 16 may be made of ceramic, without the need for a coating of a noble metal. Ceramic electrodes, although not as efficient as coated titanium electrodes, are sufficiently efficient for certain applications and provide a distinct advantage in being able to handle electrical power (the electric charge) in either polarity. A titanium substrate with one surface coated with a noble metal (such as ruthenium) provides a bipolar electrode. The coated surface becomes anodic and the uncoated surface is cathodic. Reversing the charge across a bipolar electrode rapidly destroys the substrate. However, this is not true of ceramic electrodes. So, ceramic electrodes cannot be inadvertently installed upside down.

Having the ability to reverse the polarity across a ceramic electrode provides another benefit. Production of hypochlorite from brine or seawater, because of high concentrations of magnesium and calcium, hydroxide salts tend to precipitate out and coat the electrode surfaces. Conventionally, minimizing precipitation of salts is accomplished by ensuring a minimum flow velocity of the electrolyte, such as for example 0.75 meters/sec. Because the electrodes are circular plates, flow rate across the plate from inlet to outlet aperture varies greatly, from about 0.8 meters/sec. at the inlet and outlet to about 1.2 meters/sec. at the center of the plate. These values will, of course, vary with plate size, the gap between electrodes, and the overall geometry of the cell. In the present invention using ceramic electrodes, reversing the electrical charge on the electrodes causes the precipitate hydroxide salts to be released into the electrolyte and carried away to the effluent.

A solution of copper ions has also been used as an anti-foulant. In the present invention, a stack of sacrificial copper plates may be included to provide copper ions to the solution. The stack of copper plates are preferably arranged after the electrodes that produce the hypochlorous acid ions. Also, the copper stack should be easily accessible so that, when the copper plates are expended, they can be easily replaced. It is suggested that the copper/hypochlorite combination is far more effective than hypochlorite alone.

In a preferred embodiment the plates of the electrode stack 12 are constructed to fit and seal together in an inert, insulated housing 32, to provide a safe electrolyte cell 10 that is both flexible to use and easy to maintain. The structural arrangement of the present invention provides the additional advantage that gaseous products of the electrolysis, particularly hydrogen, become entrained in the electrolyte and are carried out with the effluent. It has been found in some prior art electrolytic cells that hydrogen can migrate from operating cells to idle cells, and can present an explosion risk. In the vertical arrangement of the present invention, electrolysis gases are free to rise within the cell and are carried out of the discharge.

The present invention provides the additional advantage of being adaptable for use aboard ship as a complete assembly in sea chests (sea inlet water boxes). The center-powered, insulated design of this invention provides this advantage. Thus, no discharge pipework is required to transfer hypochlorite to the sea boxes as required in the prior art. The prior art normally requires special pipework that is resistant to the hypochlorite (pipework which often becomes blocked with hydroxides). The cell of the present invention can be installed in local machinery compartments without the need for pipework to penetrated water tight bulkheads. A central control unit may provide power to each cell (it is known in the art that penetrating bulkhead with power cables through stuffing tubes is far less critical than penetrating with pipes). Alternatively, local power transistor or thyristor/triac control units may be used for each cell. Such a cell would use thin (2 mm thick) titanium plates injection molded into the plastic body and coated with a precious metal. When the precious metal is expended, the cell is removed and replaced with a new one.

The present invention has been described in relation to preferred embodiments. However, those of skill in the art will recognize changes and modifications to the preferred embodiments that fall within the scope and spirit of the invention.

I claim:

1. An electrolytic flow cell comprising a. an insulated housing;

b. a plurality of generally planar electrodes in the housing arranged in at least a first and a second stack of electrodes;

c. an inlet port penetrating the housing to direct electrolyte to the first stack;

d. a conduit between each stack within the housing to conduct electrolyte within the housing in flow path series from the first stack to the second stack;

e. an outlet port penetrating the housing to receive effluent from the second stack; and f. electrical connections in the housing for imposing a charge on said first stack of electrodes in a first polarity and a charge on said second stack of electrodes in the opposite polarity, with the stacks arranged back-to-back in flow path series such that the polarity of the last electrode of the first stack past which the electrolyte flows is the same as the polarity of the first electrode of the second stack.

2. The flow cell of claim 1 wherein each electrode is a plate with an edge.

3. The flow cell of claim 2 further comprising a seal along the edge of each electrode and a spacer between adjacent electrodes.

4. The flow cell of claim 3 further comprising a seal with a U-shaped cross-section on the edge of each electrode.

5. The flow cell of claim 3 wherein each electrode in said stacks includes an aperture formed therein and each aperture is offset from the aperture in an adjacent electrode in the stack.

6. The flow cell of claim 3 wherein each electrode is formed of a noble metal.

7. The flow cell of claim 3 wherein each electrode comprises a substrate with first and second faces and at least one face of which is coated with a noble metal.

8. The flow cell of claim 3 wherein each electrode is ceramic.

9. The flow cell of claim 3 including a copper electrode.

10. The flow cell of claim 1 wherein the electrode stacks are arranged vertically, one on top of the other.

11. The flow cell of claim 1 wherein the total number of said stacks is an even number.

12. An electrolytic flow cell comprising a. an insulated housing;

b. a plurality of electrode stacks within the housing, each electrode stack comprising a first end of a first electrical charge and a second end of an opposite electrical charge, the electrode stacks arranged in a series fluid flow path, and the first end of one electrode stack arranged adjacent the first end of a second electrode stack in the fluid flow path, each electrode stack comprising a plurality of electrode plates each having an edge;

c. a seal on the edge of each electrode plate and abutting the housing;

d. an inlet port penetrating the housing to direct electrolyte to a first stack;

e. an outlet port penetrating the housing to receive effluent from a final stack; and f. a conduit between each stack within the housing to conduct electrolyte within the housing in flow path series.

13. The flow cell of claim 12 further comprising a spacer between adjacent electrodes of a stack.

14. The flow cell of claim 12 wherein each seal comprises a flexible member with a U-shaped cross-section.

15. The flow cell of claim 12 wherein each electrode is formed of a noble metal.

16. The flow cell of claim 12 wherein each electrode comprises a substrate with first and second faces and at least one face of which is coated with a noble metal.

17. The flow cell of claim 12 wherein each electrode is ceramic.

18. The flow cell of claim 12 including a copper electrode.

19. The flow cell of claim 12 wherein the electrode stacks are arranged vertically, one on top of the other.

20. A method of electrolysis comprising the steps of:

a. introducing an electrolyte into an electrolysis cell at an inlet port;

b. passing the electrolyte over a plurality of electrically energized electrodes arranged in a first electrode stack with an imposed charge thereon in a first polarity, the intrastack spacing between said electrodes being substantially equal;

c. passing the electrolyte through a conduit to a second electrode stack;

d. passing the electrolyte over a plurality of electrically energized electrodes arranged in a second electrode stack with an imposed charge thereon in the opposite polarity, the intrastack spacing between said electrodes being substantially equal, and the space between said first and second electrode stacks being substantially greater than the intrastack electrode spacing of each of said stacks; and e. discharging the electrolyte from the electrolysis cell at a discharge port downstream of the second electrode stack.

* * * * *